US007490904B2

(12) United States Patent
Hogg

(10) Patent No.: US 7,490,904 B2
(45) Date of Patent: Feb. 17, 2009

(54) DECREASED SKIN SHEAR DEVICE

(76) Inventor: Mark G. Hogg, 38 Marian Dr., Tonawanda, NY (US) 14150

( * ) Notice: Subject to any disclaimer, the term of this patent is extended or adjusted under 35 U.S.C. 154(b) by 0 days.

(21) Appl. No.: 11/810,545

(22) Filed: Jun. 6, 2007

(65) Prior Publication Data

US 2008/0303328 A1 Dec. 11, 2008

(51) Int. Cl.
*A47C 1/12* (2006.01)

(52) U.S. Cl. ..... 297/343; 297/340; 297/354.13; 297/354.12; 297/311

(58) Field of Classification Search ..... 297/343, 297/340, 354.13, 354.12, 311
See application file for complete search history.

(56) References Cited

U.S. PATENT DOCUMENTS 3,191,990 A * 6/1965 Rugg et al. ..... 297/83
3,567,280 A * 3/1971 Bradshaw ..... 297/318
4,362,336 A * 12/1982 Zapf et al. ..... 297/317
4,452,486 A * 6/1984 Zapf et al. ..... 297/343
4,697,846 A * 10/1987 Lucci et al. ..... 297/298
5,261,725 A 11/1993 Rudolph
5,297,021 A 3/1994 Koerlin et al.
5,549,357 A 8/1996 Counts et al.
5,634,688 A 6/1997 Ellis
5,823,621 A 10/1998 Broadhead
5,860,702 A * 1/1999 Pilarczyk et al. ..... 297/354.13
6,095,606 A * 8/2000 Opsvik ..... 297/340
6,158,810 A * 12/2000 Galloway ..... 297/354.1
6,296,265 B1 10/2001 Lovins
6,409,265 B1 6/2002 Koerlin et al.
6,425,635 B1 * 7/2002 Pulver ..... 297/343
7,040,701 B2 * 5/2006 Tada ..... 297/318

* cited by examiner

*Primary Examiner*—Laurie K Cranmer
(74) *Attorney, Agent, or Firm*—Roach Brown McCarthy & Gruber, P.C.; Kevin D. McCarthy

(57) ABSTRACT

A device that can be attached to any existing reclining type device such as chairs and beds that will eliminate shear forces on the user's body regardless of the level of movement. The primary components of the device are a seat plate, a seat slide plate, a back plate and a back slide plate. The back slide plate is pivotally attached to the seat plate. The seat slide plate is pivotally attached to the back plate. Pivoting the back plate with respect to the seat plate engages the pivotally attached seat slide plate and the pivotally attached back slide plate toward or away from each other depending on the starting position. The engagement of the slide plates mirrors the movement of the occupant in both the recline to horizontal position or the return to upright to vertical position.

9 Claims, 4 Drawing Sheets

DECREASED SKIN SHEAR DEVICE

FIELD OF THE INVENTION

The present invention is directed to decreasing and possibly eliminating a patient's skin shear.

BACKGROUND OF THE PRESENT INVENTION

Geometrically, the pivot point of an occupant's hip rotation and the pivot point of reclining back are misaligned. As the occupant is positioned in the upright position and then reclined to a horizontal position (or alternatively referred to as a supine position), the distance from the occupant's back and hamstrings contract or decrease. When starting from the horizontal position and moved to the upright position the distance from the occupant's back and hamstrings expands or increases.

Prior patents have addressed only half the problem by developing various systems that allow for a sliding type movement of the back rest. Some of those prior patents include and are not limited to U.S. Pat. Nos. 6,296,265 to Lovins—Oct. 2, 2001; 5,634,688 to Ellis—Jun. 3, 1997; 5,549,357 to Counts et al.—Aug. 27, 1996; 5,261,725 to Rudolph—Nov. 16, 1993; 5,823,621 to Broadhead—Oct. 20, 1998; 5,297,021 to Koerlin et al.—Mar. 22, 1994; and 6,409,265 to Koerlin et al.—Jun. 25, 2002.

Currently manufactured devices that recline tend to force the occupant forward when positioned from the recline to the upright position due to the friction against the occupant's back which in turn pushes the occupant's buttocks forward thereby creating a sliding effect. Those currently produced chairs address only some of the desired positioning needs of users and clinicians without regard to shear forces. The current method of dealing with shear has been the use of different support surfaces that merely mask or at best buffer some of the shear.

The aim of the invention is to mitigate these issues with a device that responds to the various forces applied to the occupant's skin.

SUMMARY OF THE INVENTION

The present invention provides a solution to the problem of skin shear due to friction between a reclining chair and the occupant's back, buttocks, and/or hamstring when the reclining chair is being reclined or reverting toward the upright position. In addition, the present invention can be fitted to currently manufactured motion furniture. Motion furniture is a device that can modify its configuration. Examples of motion furniture includes and is not limited to a Barcalounger, a hospital bed, and car seats. In other words, motion furniture can be re-configured from, for example, a conventional chair configuration to a supine configuration and positions in-between.

The present invention also addresses both the expansion and contraction movement of the occupant's middle back towards and away from the buttocks and the movement of the occupant's hamstring toward and away from the buttocks.

The present invention provides a means to eliminate and/or significantly decrease skin shear during the movement of a seated occupant by the use of a back slide plate and a seat slide plate. The purpose is to provide a means to which the user can be repositioned effectively and efficiently with significant decrease of concern about shear forces. All reclining devices (motion furniture) create movement that results in a high degree of shear force to the user. The present invention addresses this problem through the use of a device that moves in a corresponding fashion to that of the human anatomy. The device simply transfers shear force due to movement from slide plates that correspond to the user's anatomy to fixed plates. The slide plates follow the movement of the user's body during both expansion and contraction of the upper legs, hip, lower back, buttocks and back.

With the present invention, the mirroring effect of the device to the occupant's anatomy will not only minimize or eliminate skin shear, it will also allow the occupant to maintain a constant position relative to the cushions they are seated on and/or positioned over. Therefore, the occupant will not be pushed out of the chair when positioned from the recline to the upright position and will thus result in a reduction of the occupant sliding forward and out of the reclining device (motion furniture) during such movement.

The intent of the invention is to provide a device that can be maneuvered into nearly limitless positions to meet user and clinical objectives while providing a means to displace shear forces to the user body during repositioning. Furthermore, the same means to displace shear can be applied to other types of chairs as well as other devices that are designed to reposition occupants.

The intent of the invention is to provide an attached device that will reduce or eliminate shear force on the user's body regardless of the level of movement. This will also make repositioning easier for the care giver due to the reduction of friction.

DETAILED DESCRIPTION

Figures 1, 1A:
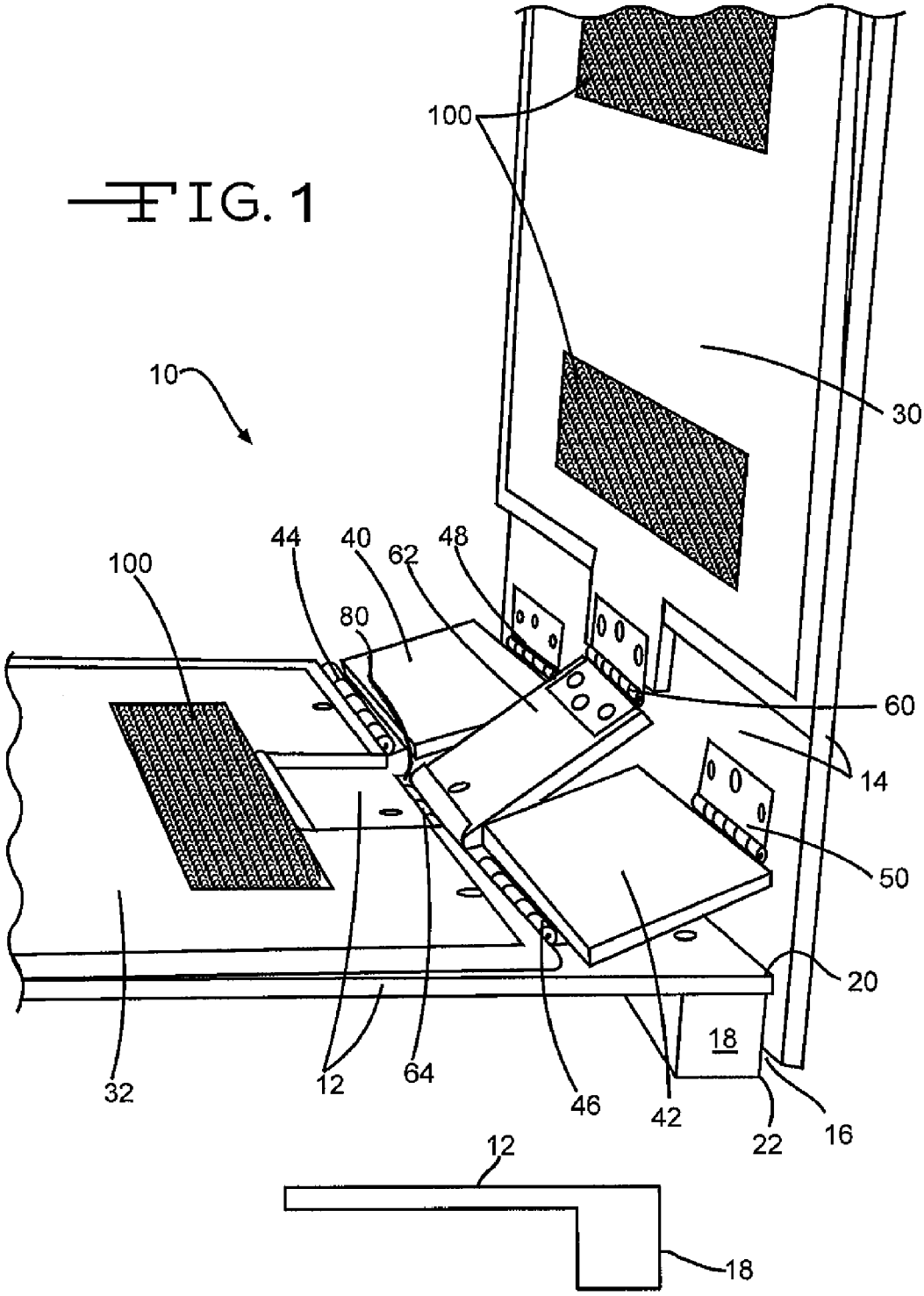
FIG. 1 is a close-up view of the shear reducing apparatus' interconnections.
FIG. 1A is an alternative embodiment of items 12 and 18 of FIG. 1.

FIG. 1 illustrates shear reducing apparatus 10 having a seat plate 12 pivotally attached to back plate 14 at point 16 through an offset unit 18. The offset unit 18 is a quarter inch to 3 inch device positioned at the seat plate's proximal end 20. The seat plate's proximal end 20 and the offset unit 18 proximal end 22 can be in the same plane and preferably are. It should be noted that the offset unit 18 can be (a) a separate and distinct piece from the seat plate 12 that is attached to the seat plate 12 or (b) an extension of the seat plate 12 so the seat plate 12 and the offset unit 18 are the same piece as shown in FIG. 1A.

Positioned over the back plate 14 is a back slide plate 30 and positioned over the seat plate 12 is a seat slide plate 32.

Back slide plate 30 is attached at hinge point 60 to back transition plate 62. Back transition plate 62 (a) is attached to seat plate 12 at hinge point 64 and (b) positioned within a seat plate opening 80. The hinge point 64 is preferably positioned on the seat plate's bottom surface—not the surface that contacts the seat slide plate 32.

Seat slide plate 32 is attached to transition plates 40 and 42 with hinges 44 and 46, respectively. Seat transition plates 40 and 42 are attached, respectively, at hinge points 48 and 50 to back plate 14.

The offset pivot point creates further distance between the seat plate 12 and the back plate 14 as the motion furniture (not shown) is reclined from the seat position. This offset allows both slide plates 30 and 32 to move or displace in a fashion that mirrors the contraction of the occupants body during the recline motion. The reverse is true when the motion furniture is positioned from a supine or recline position toward the upright position.

Additionally, the point at which the hinge points 48 and 50 are attached to the back plate 14 affects the rearward and forward distance the seat slide plate 32 is displaced. The same is true for the hinge point 64 attached to seat plate 12 in affecting the amount of movement of back slide plate 30. Furthermore, the number of transitional plates in conjunction with different pivot points will also affect the amount of movement in both slide plates 32 and 30.

Figure 2A:
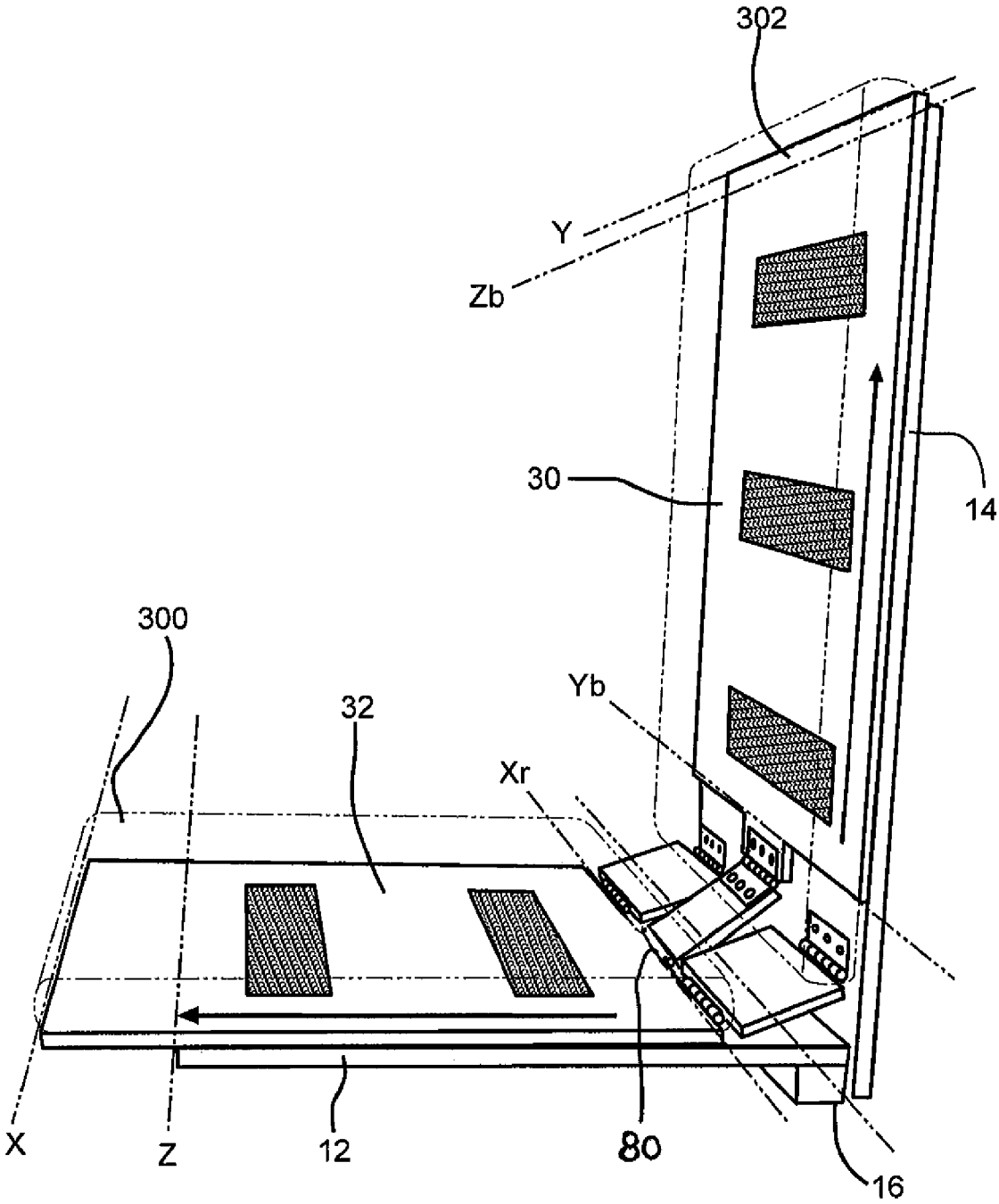
FIGS. 2*a-c* are illustrations of the shear reducing apparatus in a chair conformation (FIG. 2*a*), a reclining conformation (FIG. 2*b*) and a supine conformation (FIG. 2*c*).

The areas that are marked as 100 represent attachment points for surface cushions 300, 302 as illustrated at FIG. 2A. The attachment points illustrated in FIG. 1 use a conventional hook and loop fastening system wherein the surface cushions have the loop material and the slide plates 30, 32 have the hook materials.

Figure 2B:
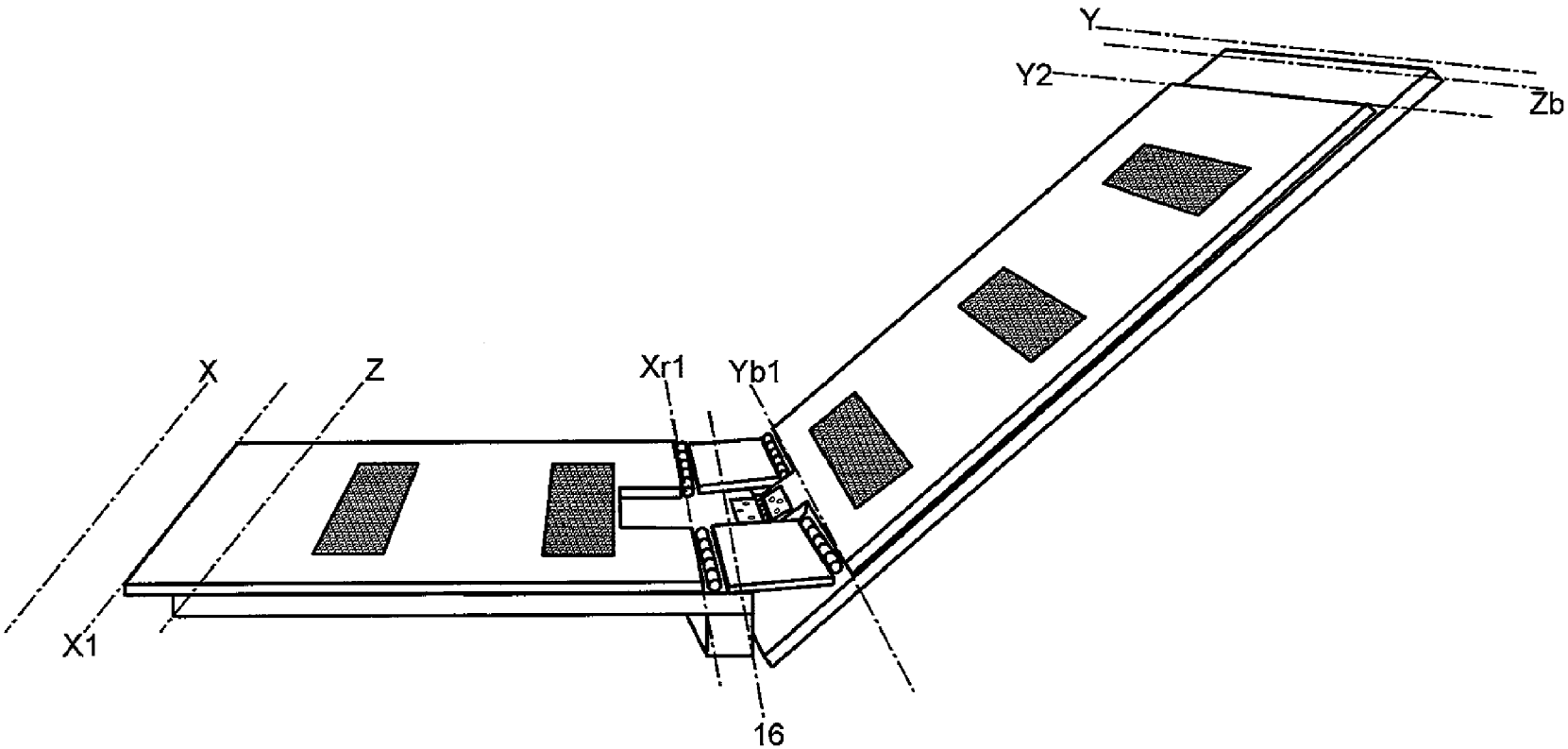
Figure 2C:
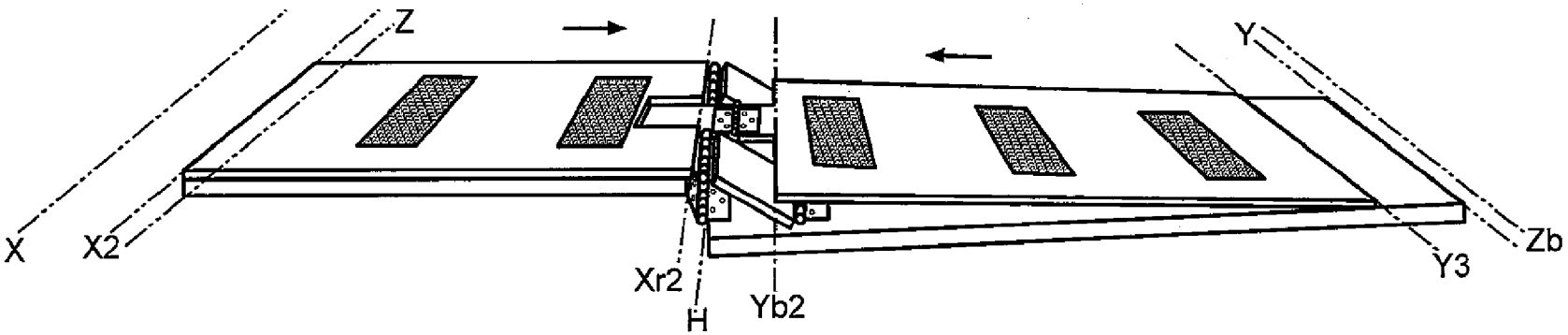

FIG. 2 shows the movement of slide plates 30, 32 on fixed plates 14, 12 for both the seat and back when the chair is upright (FIG. 2*a*), reclined (FIG. 2*b*) and horizontal (FIG. 2*c*). With the back plate 14 and seat plate 12 at perpendicular (90°), the recline sequence and reactions to it are as follows:

X Front of seat slide plate at 90°

XR Rear of seat slide plate at 90°

YB Bottom of back lower slide plate at 90°

Y Top of back lower slide plate at 90°

Z Distal end of the seat plate

ZB Proximal end of the back plate.

The seat plate 12 is attached at offset pivot point 16 to the back plate 14 and positioned at 90 degrees to each other as illustrated in FIG. 2*a*. That configuration of seat plate 12 to back plate 14 forces the seat slide plate 32 to move forward in relation to the front Z of seat plate 12. This is demonstrated by FIG. 2*a* where x is the start point at 90°.

As the back plate 14 is moved toward further reclination, the front X of the seat slide plate 32 moves rearward with each degree decrease in angle of the back plate to the seat plate. The position of X for the seat slide plate during the reclining movement are identified as X1 (FIG. 2*b*) and X2 (FIG. 2*c*) respectively. The positions X1 (FIG. 2*b*) and X2 (FIG. 2*c*) show the increasing distance from the original start point X.

The start point (FIG. 2*a*) of the proximal end of the seat slide plate 32 is denoted as XR and FIGS. 2*b* and 2*c* show the movement of the seat slide plate 32 in relation to the back slide plate 30. The seat slide plate 32 and lower back slide plate 30 are forced toward each other. As shown in FIGS. 2*a-c* the movement of the back slide plate 30 is controlled by being attached to the seat plate 12. Slide plates 32 and 30 are forced to continue moving toward each other as illustrated by the arrows (FIG. 2*c*) when the present invention is converted from the upright position (FIG. 2*a*) toward the supine position (FIG. 2*c*). The movement toward each other is further confirmed by comparing the distances between XR and YB in FIG. 2*a* to (a) the distance between XR1 and YB1 in FIG. 2*b* (notice the decreased gap between the YB1 and the transition plates 40, 42) and (b) the distance between XR2 and YB2 in FIG. 2*c* (notice the back slide plate 30 is positioned on the transition plates 40, 42). This comparison is shown by comparing the positions of Xr, Xr1 and Xr2, as well as, the positions of Yb, Yb1 and Yb2 in the respective FIGS. 2*a-c*.

The amount of seat and lower back slide movement is also determined by the angle between the back plate and the seat plate—the greater the angle between the back plate to the seat plate increases the movement of the corresponding slide plates.

The amount of movement can also be controlled by changing the attachment point FIG. 1 (48 and 50) of the seat slide plate to the back plate and the attachment point 64 of the back slide plate to the seat plate.

A purpose of this anti shear device is to allow for the slide plates to move in relation to the body's anatomy positioned above the slide plates 30, 32. The components of the device collapse to the body's pivot point (hip) reducing or eliminating shear to both the back and buttocks. The back slide plates collapse downward to the seat when reclining. The seat slide plate collapses horizontally and rearward toward the back when reclining.

When adjusting the back from the recline position to the upright position the device reacts in reverse.

Whereas the present invention has been described with respect to a specific embodiment thereof, it will be understood that various changes and modifications will be suggested to one skilled in the art and it is intended to encompass such changes and modifications as fall within the scope of the appended claims.

I claim:

1. A shear force reducer:

a seat plate having a top surface, a bottom surface a distal end and a proximal end, at the proximal end is an offset unit that protrudes from the bottom surface;

a back plate having a top surface, a bottom surface, a distal end and a proximal end, and at the back plate's distal end is pivotally interconnected to the seat plate at the offset unit;

a seat transition plate having a distal end and a proximal end;

a back transition plate having a distal end and a proximal end a sliding seat plate (a) positioned over the seat plate, (b) has a proximal end that is pivotally interconnected to a seat transition plate's distal end;

the seat transition plate's proximal end is pivotally interconnected to the back plate's top surface;

a sliding back plate (a) positioned over the back plate and (b) has a distal end that is pivotally interconnected to a back transition plate's proximal end;

the back transition plate's distal end is pivotally interconnected to the seat plate's bottom surface and positioned within the back transition plate opening when the shear force reducer is in a supine position.

2. The shear force reducer of claim 1 wherein the shear force reducer is positioned over a seating/reclining/supine apparatus having (a) a seat section to receive an occupant's buttocks and legs and (b) a back section to receive the occupant's back area, the seating/reclining/supine apparatus can convert from a sitting position wherein the seat section and back section are perpendicular or nearly perpendicular to each other, to the supine position wherein the seat section and the back section are in the same plane or nearly the same plane to each other, and between the supine position and the sitting position is the reclining position.

3. The shear force reducer of claim 1 further comprising a first cushion positioned over the sliding back plate and a second cushion positioned over the sliding seat plate.

4. The shear force reducer of claim 3 wherein the first cushion is interconnected to the sliding back plate.

5. The shear force reducer of claim 3 wherein the second cushion is interconnected to the sliding seat plate.

6. The shear force reducer of claim 1 wherein the offset unit is greater than a quarter of an inch.

7. The shear force reducer of claim 1 wherein the offset unit is less than 3 inches.

8. The shear force reducer of claim 1 wherein the offset is a distinct component interconnected to the seat plate.

9. The shear force reducer of claim 1 wherein the offset and the seat plate are a single piece.

* * * * *